United States Patent [19]

Broadbent

[11] Patent Number: 4,990,169

[45] Date of Patent: Feb. 5, 1991

[54] ICE MAKING METHOD AND OR APPARATUS

[75] Inventor: John A. Broadbent, Golden Valley, Minn.

[73] Assignee: Broad Research, Golden Valley, Minn.

[21] Appl. No.: 410,369

[22] Filed: Sep. 21, 1989

Related U.S. Application Data

[63] Continuation-in-part of Ser. No. 271,228, Nov. 14, 1988, Pat. No. 4,922,723.

[51] Int. Cl.[5] ..... F25C 1/12

[52] U.S. Cl. ..... 62/72; 62/75; 62/349

[58] Field of Search ..... 62/72, 75, 347, 353, 62/233, 352, 349

[56] References Cited

U.S. PATENT DOCUMENTS

| | | | |
|---|---|---|---|
| 1,878,759 | 9/1932 | Copeman | 62/354 |
| 2,610,476 | 9/1952 | Field | 62/106 |
| 2,613,511 | 10/1952 | Walsh | 62/107 |
| 2,683,356 | 7/1954 | Green, Jr. | 62/106 |
| 2,683,359 | 7/1954 | Green, Jr. | 62/114 |
| 2,770,102 | 11/1956 | Roedter | 62/353 X |
| 2,803,950 | 8/1957 | Bayston | 62/107 |
| 2,918,803 | 12/1959 | Bauerlein et al. | 62/353 X |
| 2,969,651 | 1/1961 | Bauerlain | 62/353 X |
| 2,990,199 | 6/1961 | Field | 62/72 |
| 3,253,424 | 5/1966 | Van Steenburgh, Jr. | 62/298 |
| 3,308,631 | 3/1967 | Kniffin | 62/137 |
| 3,318,106 | 5/1967 | Litman | 62/189 |
| 3,380,560 | 6/1968 | Moreland, II | 62/72 X |
| 3,404,543 | 10/1968 | Diblick | 62/344 |
| 3,739,595 | 6/1973 | Learn et al. | 62/135 |
| 4,412,429 | 11/1983 | Kohl | 62/347 |
| 4,425,964 | 1/1984 | Nelson | 62/347 |
| 4,685,304 | 8/1987 | Essig | 62/68 |

FOREIGN PATENT DOCUMENTS

| | | |
|---|---|---|
| 150952 | 5/1904 | Fed. Rep. of Germany . |
| 1601076 | 5/1970 | Fed. Rep. of Germany . |
| 1601076 | 5/1970 | Fed. Rep. of Germany . |
| 1213778 | 4/1960 | France . |
| 2343209 | 9/1977 | France . |
| 182324 | 7/1922 | United Kingdom . |

OTHER PUBLICATIONS

English translation of French Publication 2,343,209.
Patent Cooperation Treaty International Search Report PCT/US 89/05001.

*Primary Examiner*—William E. Tapolcai
*Attorney, Agent, or Firm*—Merchant, Gould, Smith Edell, Welter & Schmidt

[57] ABSTRACT

An ice product bearing a clearly discernable pattern or design caused by the controlled formation of cloudy ice within an otherwise clear ice cube, and a machine or apparatus for producing such cubes comprising a flexible membrane (56) which is urged into and out of thermal contact with a refrigerated surface (51) upon which raised conductive areas (52) define discrete freezing sites which determine where on the flexible membrane the ice cubes are formed and then removing the ice cubes by flexing the flexible membrane.

27 Claims, 7 Drawing Sheets

ICE MAKING METHOD AND APPARATUS

TECHNICAL FIELD

This invention relates generally to Refrigeration. More particularly, this invention concerns a method and apparatus for freezing ice cubes on a flexible membrane. This invention is a continuation-in-part and improvement over my prior application Ser. No. 271,228, filed Nov. 14, 1988, now U.S. Pat. No. 4,522,723 and entitled "Apparatus and Method for Making Ice Cubes Without a Defrost Cycle."

BACKGROUND OF THE INVENTION

Automatic ice cube machines are widely used in restaurants, bars, hotels, etc. Such commercial machines typically form ice cubes by freezing a flowing stream of water on the chilled evaporator portion of a refrigeration system. After the ice has been formed to the desired thickness, the evaporator is heated, thereby melting the bond between the ice and the evaporator and allowing the ice to then fall or be pushed into an ice holding bin below. Heating of the evaporator is typically accomplished using "hot gas defrost," whereby hot refrigerant gas from the compressor is caused to bypass the condenser and go directly into the evaporator. The hot gas defrost cycle ends after the ice cubes have fallen away from the evaporator. Such a hot gas defrost cycle adversely affects the capacity and energy efficiency of the ice machine. The ice making capacity is significantly reduced because: (1) the machine spends a substantial portion of its time defrosting, during which time no useful refrigeration is provided, (2) the ice machine melts some ice during defrost, and (3) the heat added to the evaporator during hot gas defrost must be removed from the evaporator before freezing can resume—which means that the machine's refrigerating capacity is being used to remove heat added during defrost rather than to make ice. Also, because the ice making machine is consuming energy during the defrost process but is not making ice, the energy efficiency is significantly lower than that of an ice machine with no hot gas defrost cycle.

The capacity and energy efficiency of an ice making machine are also affected by the refrigeration system's condensing temperature. It is well known that raising condensing temperature in a refrigeration system leads to a reduction of the heat transfer output and efficiency of the system. Cube making ice machines often are designed to have a higher condensing temperature than would otherwise be required in order to assure that sufficiently hot refrigerant gas is available to provide a quick defrost. This leads to lower capacity and efficiency.

Another disadvantage of ice machines using hot gas defrost is their reduced service life. An ice machine which utilizes a hot gas defrost cycle constantly cycles between warm and cold. This constant thermal cycling causes the main components to wear out faster than they would otherwise. Yet another drawback of most existing ice cube making machines is their inability to produce ice cubes of various shapes and sizes. An ice machine with the ability to make ice cubes of various shapes would have an advantage in the marketplace over traditional ice machines.

Yet another drawback of most existing ice cube making machines is their inability to produce both fairly thick "cube" ice and very thin "flake" ice. Since many commercial establishments have a need for both types of ice (for example in a restaurant, cubes are used in drinks and flake ice is used in the salad bar), a machine capable of producing both types would be very desirable. Various machines and methods for making ice have been available heretofore. For example, U.S. Pat. Nos. 2,610,476 and 2,990,199 to C. Field, 2,613,511 to E. C. Walsh, 2,683,356 and 2,683,359 to Charles M. Green, Jr., and 2,803,950 to J. R. Bayston all describe methods for making ice on a flexible or deformable surface which do not require a hot gas defrost cycle. However, all of these methods produce randomly shaped pieces of ice as each method fractures the ice as it is broken free of the deformable freezing surface. None of these methods allow the ice to have a controlled cross-sectional shape.

U.S. Pat. No. 4,412,429 to Vance L. Kohl describes an ice making method providing a jacket around an evaporator tube having intersecting ridges which define an array of fluid removing means for removing said flexing fluid from said sites for growing the ice cubes, with the "bottom" of each site being in close contact with an area of evaporator tube for freezing water applied thereto. During harvesting, water is circulated through the jacket to uniformly melt and loosen the cubes so they may fall away. The jacket may be made of a flexible plastic material so that filling said jacket with water during said harvest mode causes flexing thereof to help dislodge the ice cubes or particles. While this method does not use a hot gas defrost and does use some flexing to remove ice from the freezing surface, it harvests the ice primarily through melting. The "bottom" of each freezing site (the primary contact area between ice and evaporator) is securely fastened to the evaporator tube and is not flexible; the ice can only be freed from this area by melting. Only the periphery of each freezing site is capable of any flexing. This method is designed to produce thick "cube" type ice and is not well suited for producing thin "flake" ice. Commercially available flaker-type ice machines do not utilize a hot gas defrost cycle, but they cannot make cubes, much less cubes of various predetermined configurations.

The primary objective of this invention is to provide a machine or apparatus for making hard, primarily clear, uniformly shaped ice in various configurations, both cubed and noncube-shaped, which does not require hot gas defrost and which thus provides greater ice producing capacity, greater energy efficiency and longer service life than conventional cube making ice machines.

SUMMARY OF THE INVENTION

The invention herein comprises an ice making method and apparatus which provides improved ice making capacity, greater energy efficiency and longer service life through a novel means of forming and harvesting ice of various configurations. In addition it provides the flexibility to produce clear, uniformly shaped ice cubes of any desired cross-sectional shape and thickness.

As used herein, the term "cube" shall not be limited to describing a regular solid piece of ice with six sides, but includes solid pieces of ice of any suitable shape. The term "flake ice" refers to thin pieces of ice with thicknesses typically ranging from 0.06 to 0.24 inches. Also, in describing the ice formed by the present invention, the "back" side of the ice cube refers to that side of the ice cube which is in contact with the evaporator of the ice machine, and which is the side of the ice cube frozen first. This invention deals primarily with the evaporator or ice forming portion of an ice making machine. The other components required in the ice-making machine (i.e., refrigeration system, water source and flow control, ice holding bin, etc.) are similar to those found in conventional ice-making machines.

In the preferred embodiment, ice is formed on a very thin, flexible membrane (e.g., a 0.001 or 0.002 inch thick sheet of stainless steel or a sheet of plastic of suitable thickness) which is connected to a vertically oriented refrigerated surface. The flexible membrane and the refrigerated surface are arranged so that a sealed chamber is defined therebetween. This chamber is connected to a fluid circulating circuit containing a low toxicity, low freezing temperature fluid (such as propylene glycol or DOWFROST, hereafter referred to simply as flexing fluid) which will be used to flex the flexible membrane in and out. In the preferred embodiment, raised conductive areas on the refrigerated surface define areas of high thermal conductivity between the flexible membrane and the refrigerated surface by determining the areas where they may come into contact. By applying a slight vacuum or lower than ambient pressure to the chamber between the flexible membrane and the refrigerated surface a method for applying the vacuum will be described) the flexible membrane is drawn into intimate contact with the refrigerated surface at the raised conductive areas or freezing sites. Water flowing on the exterior side of the flexible membrane freezes on those areas where there is high thermal conductivity between the flexible membrane and the refrigerated surface, i.e. the areas defined by the raised freezing sites. The shape of these raised conductive areas or freezing sites thus determine the cross-sectional shape of the resultant ice cubes.

Alternate embodiments of the present invention may define the freezing sites by means other than raised conductive areas. For example an insulating layer with an array of holes in it could be used to define the freezing sites.

When the ice cubes have reached the desired thickness, as determined by a timing device for example, a pump is energized which forces warm flexing fluid to flow through the chamber between the refrigerated surface and the flexible membrane. This causes the flexible membrane to be flexed away from the refrigerated surface thereby breaking the bond between the ice and the flexible membrane and thus allowing the ice to fall from the flexible membrane and into an ice holding bin below. By keeping the flexing fluid above the freezing temperature of water (i.e., above 32° F. or 0° C.), this fluid also facilitates the removal of any ice cubes remaining on the flexible membrane by melting the ice which is holding the cubes to the membrane. This ice harvesting method is very fast, with ice being completely removed from the evaporator in less than 10 seconds (compared to hot gas defrost which can take two or more minutes).

Once the ice has broken or melted free of the flexible membrane, again as determined by a timing device, the flexing fluid pump is turned off. By locating the reservoir which holds the flexing fluid below the level of the evaporator, the flexing fluid is caused by gravity to flow down into this reservoir, and the resulting hydrostatic pressure causes a slight vacuum to exist in the chamber between the refrigerated surface and the flexible membrane. This vacuum causes the flexible membrane to again be brought into contact with the refrigerated surface, thus restarting the freezing process. A sufficiently strong vacuum will exist as long as the level of the flexing fluid in the reservoir is approximately two or more feet below the level of the evaporator.

The thickness of the ice produced is controlled by an adjustable timing device which determines how long the ice is allowed to freeze before the flexing fluid pump is turned on to harvest the ice. It is a very simple matter to vary the thickness of the ice produced by simply setting the timer to the length of freezing time which corresponds to the desired ice thickness. A short freezing time results in thin "flake" ice, a long freezing time produces thick "cube" ice.

The process for making ice cubes which bear patterns or designs will now be described. When a flowing stream of water is frozen quickly, the impurities and gases in the water become trapped in the ice and cause it to be white or cloudy. When a flowing stream water is frozen more slowly, these impurities and gases are washed away and the ice formed is clear or transparent. The formation of clear or cloudy ice is also affected by the velocity of water relative to the freezing surface. By controlling the rate of heat transfer and the velocity of water, it is possible to freeze water such that the cloudy and clear ice form desirable patterns in the ice.

In this invention, the formation of patterns or designs in the ice is accomplished by creating areas of higher and lower thermal conductivity between the raised freezing sites and the flexible membrane such that as ice first begins to form on the flexible membrane, it freezes fast and thus cloudy in areas of higher thermal conductivity and slow and thus clear in areas of lower thermal conductivity. The desired pattern is achieved by arranging these areas of higher and lower thermal conductivity into patterns such that areas desired to be cloudy are made to have higher thermal conductivity and areas desired to be clear are made to have lower thermal conductivity. As the ice grows in thickness, the insulating effect of the ice causes the freezing rate to drop over the entire freezing area. This stops the formation of cloudy ice and causes the cubes to be predominantly clear. Thus this method results in clear ice cubes which have a thin layer of white cloudy ice on one side (the "back" side), with a pattern formed in that cloudy layer.

The patterns or designs formed in this thin layer of cloudy ice can be either white on a clear background or clear on a white background. Because the resolution of the patterns formed with this method is quite good, the patterns can be virtually any type of graphic image including letters, numbers, words, messages, logos, pictures, etc. Because the cloudy ice which forms the patterns on the ice cubes is formed due to the entrapment of impurities in the water supplied, it is possible to add flavorings and/or colorings to the water and have those flavorings and/or colorings frozen into the thin cloudy layer. When the flavorings and/or colorings are in the proper concentrations, the resulting ice cubes will be predominantly clear, but will have a colored and/or flavored layer of cloudy ice on the "back" side of the cube. This colored and/or flavored cloudy ice layer will also bear the desired pattern or design as described.

In the preferred embodiment, the raised freezing sites on the refrigerated surface are areas of high thermal conductivity and define the areas where ice cubes are formed. To create a pattern of lower thermal conductivity on these freezing sites, and thus areas where clear rather than cloudy ice is formed, conductive material is removed (for example by etching or stamping) from the raised freezing sites in areas where the clear ice is desired. This prevents the flexible membrane from contacting the freezing site as closely in those areas as in the areas where conductive material has not been removed. A removal needed reduction in thermal conductivity when 0.001 inch stainless steel is used as the flexible membrane material.

Other possible methods for creating areas of higher and lower thermal conductivity between the refrigerated surface and the flexible membrane include: (1) depositing additional conductive material on top of the freezing sites to create areas of higher thermal conductivity, (2) placing an additional layer of conductive material between the freezing sites and the flexible membrane to create areas of higher thermal conductivity, (3) placing a very thin insulating layer between the freezing sites and the flexible membrane to create areas of lower thermal conductivity, (4) varying the surface finish of either the freezing site or the flexible membrane (e.g., a rough finish will have lower thermal conductivity than a smooth finish), (5) embossing the flexible membrane to create areas of good and poor thermal contact between the flexible membrane and the freezing site, and (6) combinations of items 1 through 5 above.

BRIEF DESCRIPTION OF DRAWINGS

A better understanding of the invention can be had by reference to the following Detailed Description in conjunction with the accompanying Drawings, wherein:

FIG. 8 is plan view of an ice cube formed with the present invention with the word "ICE" imbedded therein;

FIG. 9 is a cross-sectional view, taken along the line 9—9 of FIG. 8;

FIG. 10 is a plan view of a raised freezing site of a type needed to produce the ice cube of FIGS. 8 and 9;

FIG. 11 is a cross-sectional view, taken along the line 11—11 of FIG. 10;

DETAILED DESCRIPTION

Figure 1:
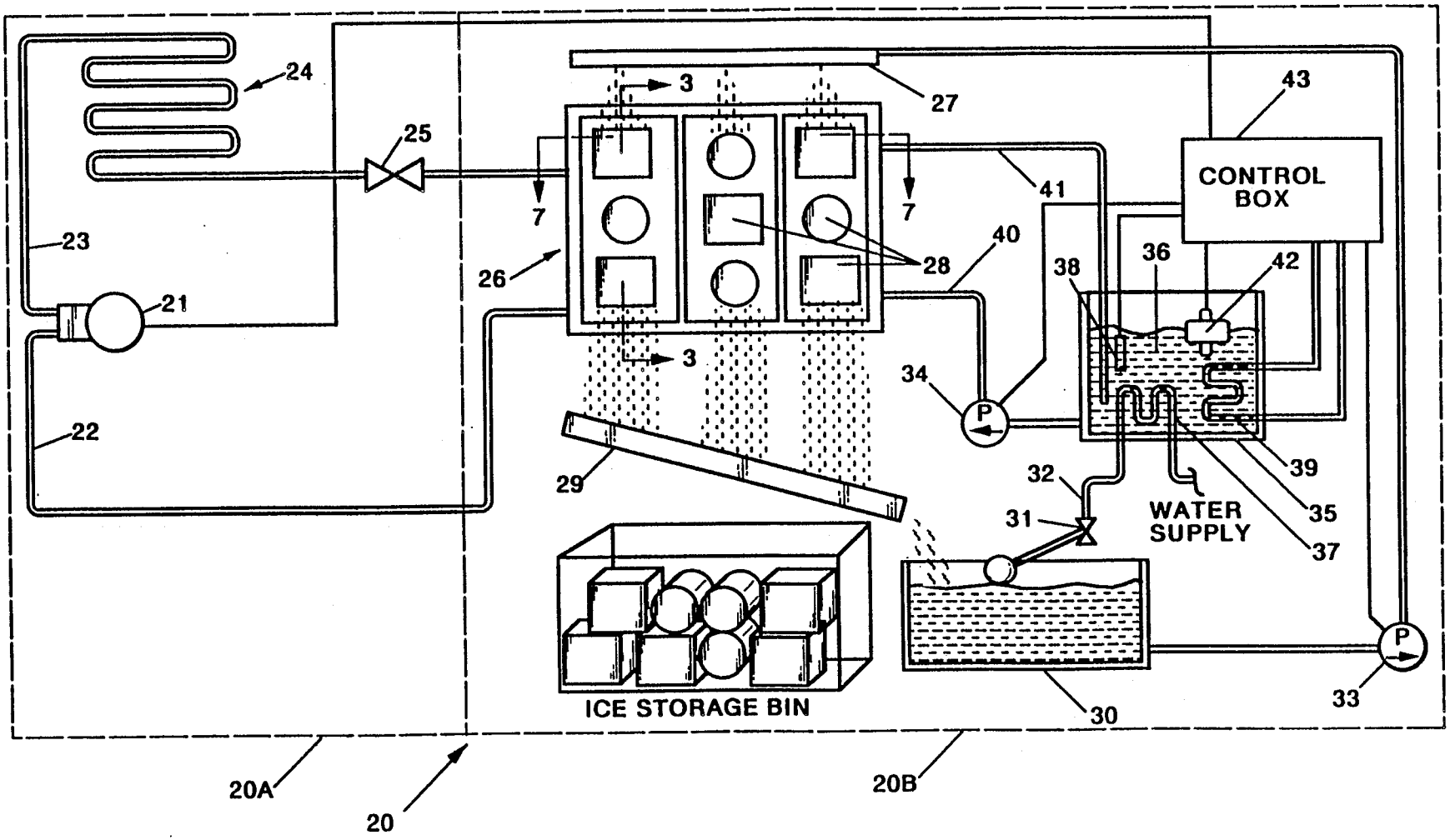
FIG. 1 is a schematic diagram illustrating the refrigeration circuit, water supply circuit, and the flexing fluid circuit of the present invention.

Referring now to the Drawings, wherein like reference numerals designate like or corresponding parts throughout the views, and particularly referring to FIG. 1, there is illustrated a schematic diagram of a refrigeration circuit 20 incorporating the invention. The refrigeration circuit 20 is divided into two segments 20A and 20B.

The segment 20A comprises that portion of the refrigeration circuit 20 which contains certain conventional elements. These elements include a compressor 21 having a suction line 22 and a discharge line 23. In the discharge line 23 there is a condenser 24 for condensing the compressed refrigerant vapor coming from the compressor 21, and an expansion valve 25 for flashing a portion of pressurized liquid refrigerant into a vapor thereby lowering the temperature and pressure of the remaining unvaporized refrigerant.

The segment 20B comprises that portion of the refrigeration circuit 20 incorporating the present invention. To complete the refrigerant circuit 20, an evaporator 26 is connected between the discharge line 23 and the suction line 22. The details of evaporator 26 comprise significant features of the invention, as will be described hereinbelow.

Gaseous refrigerant is compressed, condensed to a liquid and then expanded, in the form of a liquid spray into the evaporator 26. Heat transferred into the liquid refrigerant causes it to evaporate. The evaporated refrigerant passes through suction line 22 back to the compressor 21.

FIG. 1 also illustrates the water supply circuit used to provide water to the evaporator 26 for making ice. A water supply manifold 27 distributes a continuous stream of water across the surface of the evaporator 26. The water which is not frozen at the freezing sites 28 while crossing the evaporator surface is collected below in a collection trough 29. The water then flows back into a tank or reservoir 30. A constant level of water is maintained in the reservoir 30 by means of a float valve 31 which regulates flow from the water supply 32. A pump 33 circulates water from the reservoir 30 to the water supply manifold 27.

Also shown in FIG. 1 is a pump 34 and a reservoir 35 for holding flexing fluid 36. Reservoir 35 is located physically below the level of the evaporator 26. There is located in reservoir 35 a heat exchanger 37 through which the tap water used to make ice passes before it enters the float valve 31. This heat exchanger 37 serves two functions. First, it uses the excess heat in the water to help maintain the flexing fluid 36 at a sufficiently warm temperature so that the ice harvesting occurs quickly. Second, the heat exchanger 37 pre-cools the entering water, thereby increasing the capacity of the ice machine. Also located in reservoir 35 is a temperature sensor 38 and a electrical resistance heater 39 which are used together to prevent the flexing fluid 36 from falling below a minimum set temperature. This is needed when the entering water is too cold to provide sufficient heat to maintain the temperature of the flexing fluid 36.

The flexing fluid 36 is pumped into evaporator 26 through conduit 40 and returns to reservoir 35 through conduit 41. A fluid level switch 42 in reservoir 35 turns the ice machine off if the flexing fluid 36 falls below a set level. This prevents the machine from operating when there is a leak in the flexing fluid circulating circuit which could result in the ice becoming contaminated with flexing fluid. The operation of switch 42 also prevents the ice machine from operating when the flexing fluid level is at a level which would lead to damage to the pump 34 or the electric heater 39.

Also shown in FIG. 1 is a control box 43 containing the circuitry necessary to control the operation of the ice machine. Included in control box 43 is a thermostatic control to operate heater 39 in response to signals from temperature sensor 38, a timing device to control the operation of pump 34, and circuitry needed to de-energize the entire ice machine in response to a loss of flexing fluid as indicated by fluid level switch 42. The pump 34, reservoir 35, flexing fluid 36, heat exchanger 37, temperature sensor 38, heater 39 and conduits 40 and 41 are used in the operation of the evaporator 26 as will be described.

Figure 2:
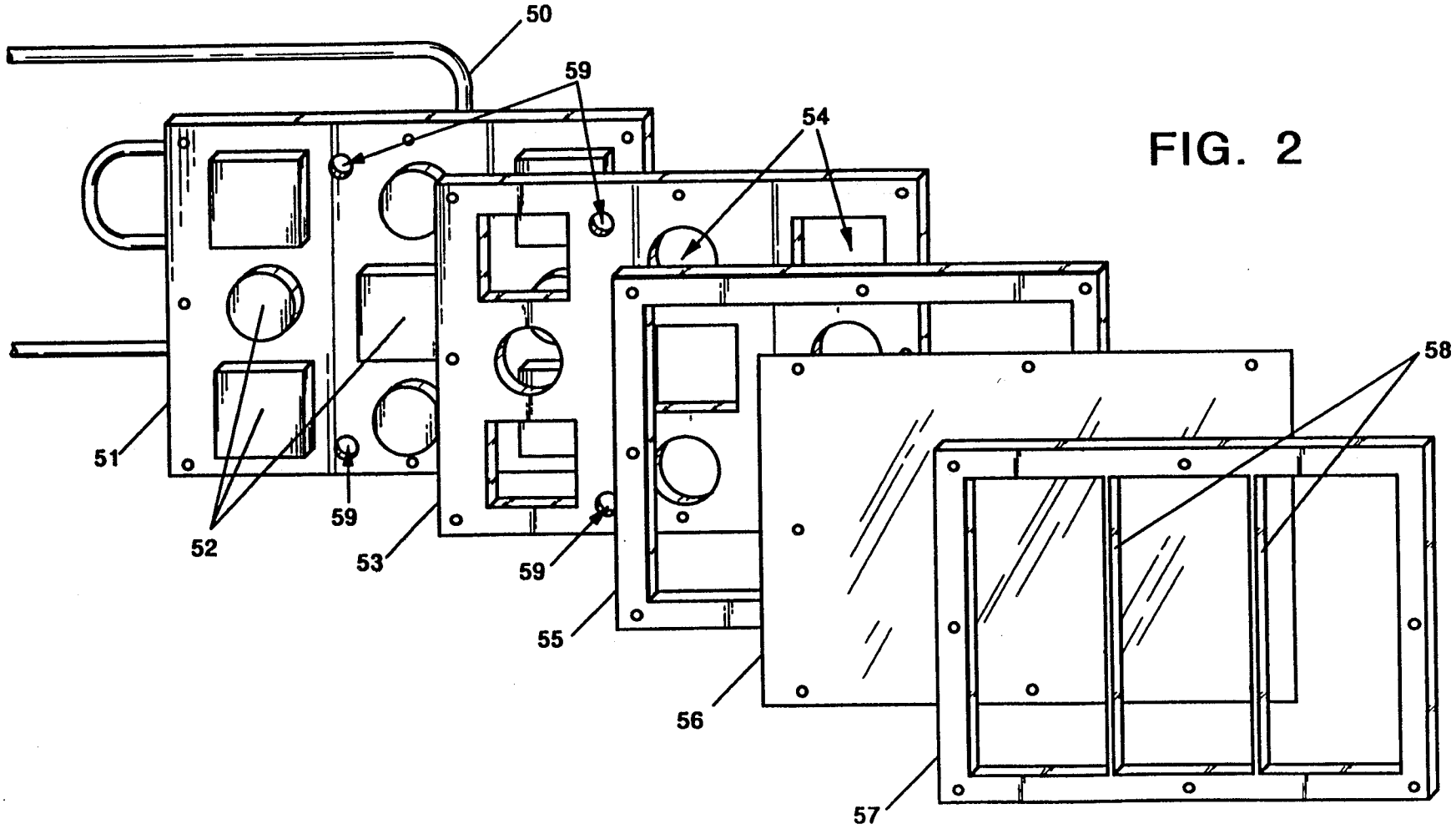
FIG. 2 is an exploded view of the preferred embodiment of the ice making apparatus.

FIG. 2 is an exploded view of the evaporator 26. Starting from the back, the evaporator 26 is comprised of a serpentine length of tubing 50 through which the refrigerant passes. The tubing 50 is connected directly to a plate 51 so that there is good conduction of heat between the tubing and the plate.

Plate 51 has on it an array of raised freezing sites 52 which protrude up from the surface of the plate 51. These raised freezing sites 52 can be of whatever cross-sectional shape is desired (the shapes shown in FIG. 2 are circles and squares) and will determine the cross-sectional size and shape of the ice cubes produced by the present invention. Thus ice cubes of any desired cross-sectional shape can be made simply by constructing plate 51 with freezing sites 52 with the shape desired for the ice cubes.

Attached to the plate 51 is a layer or sheet of insulating material 53. This insulating layer 53 has cut in it a series of holes 54 through which the raised freezing sites 52 protrude. This layer of insulation 53 inhibits heat transfer from areas other than the raised freezing sites, thus preventing unneeded cooling of the flexing fluid 36.

Also on the surface of the plate 51 is a peripheral gasket 55. In front of the gasket 55 and the insulating layer 53 is a thin flexible membrane 56. In the preferred embodiment this membrane is a 0.001 to 0.002 inch thick piece of stainless steel. As will be explained more fully hereinafter, ice is formed on the exterior side of the flexible membrane 56. The space between the membrane 56 and the plate 51 (enclosing the insulating layer 53 between them) is sealed by gasket 54 to define a sealed chamber therebetween through which flexing fluid 36 will be pumped. The entire assembly is held in place by a retaining frame 57 which can be fastened to the plate 51 by bolts or other retaining means. The retaining frame 57 has on it supporting struts 58 whose function will be described. Also shown in FIG. 2 are holes 59 in plate 51 and insulating layer 53 which allow the flexing fluid to enter and exit the chamber created between the plate 51 and flexible membrane 56.

FIGS. 3 through 6 are cross-sectional views of the evaporator 26 when assembled and illustrate the sequence of operation of the present invention. Shown in each of FIGS. 3 through 6 are the flexing fluid conduits 40 and 41, the tubing 50, plate 51, the raised freezing sites 52, the insulating layer 53, the gasket 55, the flexible membrane 56, and the retaining frame 57. Each of FIGS. 3 through 6 also show water 70 flowing vertically down across the surface of the flexible membrane 56 in the direction of the arrow.

Figure 3:
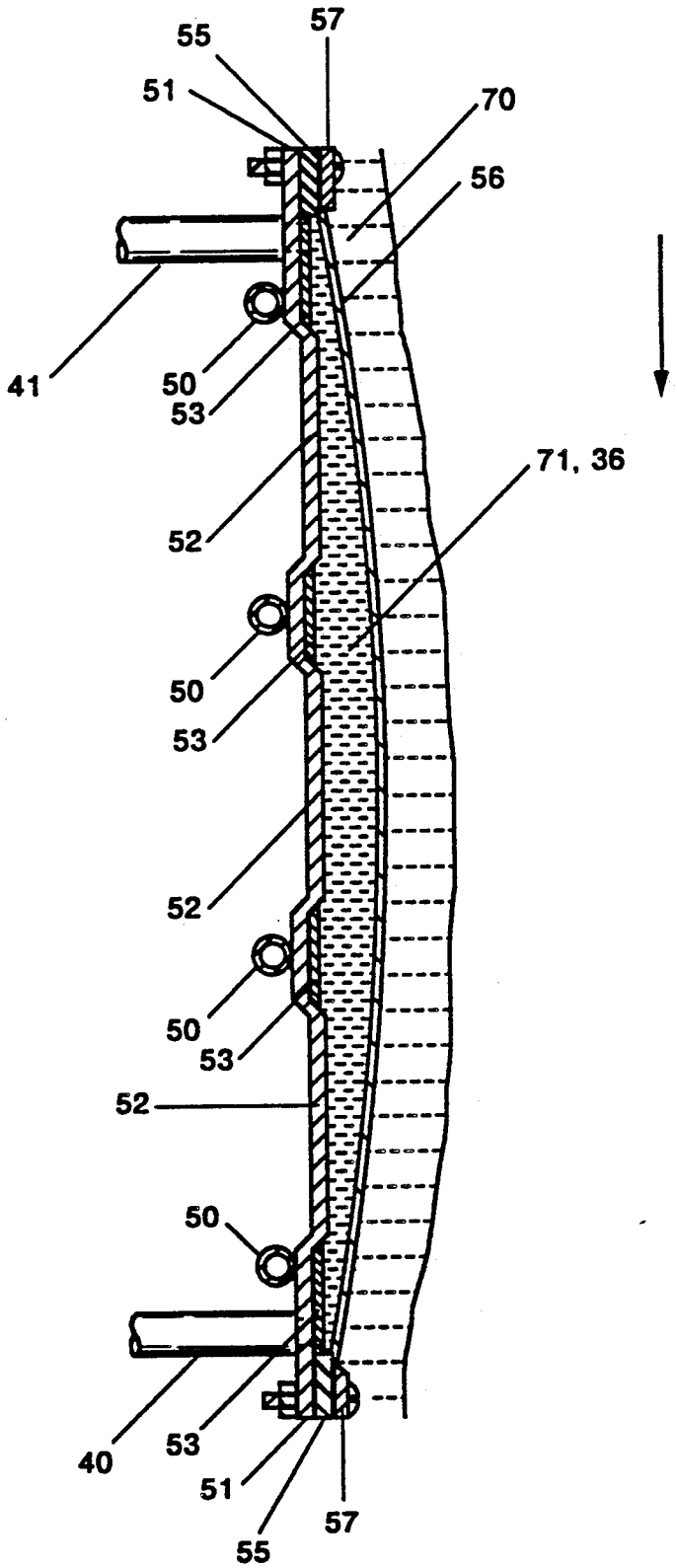
FIG. 3 through FIG. 6 are cross-sectional views, taken along the line 3—3 of FIG. 1, illustrating the sequence of operation of the present invention.

FIG. 3 shows the state of evaporator 26 when the ice making machine is first energized. At this time compressor 21 is energized, causing cold refrigerant to begin flowing through conduit 50 thus causing plate 51 and raised freezing sites 52 to become cold. Water circulating pump 33 is turned on, causing water 70 to circulate across the exterior of evaporator 26. Pump 34 is also energized, forcing flexing fluid 36 through conduit 40 into the chamber 71 between the flexible membrane 56 and the plate 51 such that flexible membrane 56 is caused to flex away from, and out of thermal contact with, plate 51. The flexing fluid exits from evaporator 26 through line 41. In addition to causing flexible membrane 56 to move away from plate 51, the flexing fluid 36 also removes any water or moisture from chamber 71 which could later freeze and disrupt the operation of the device.

Figure 4:
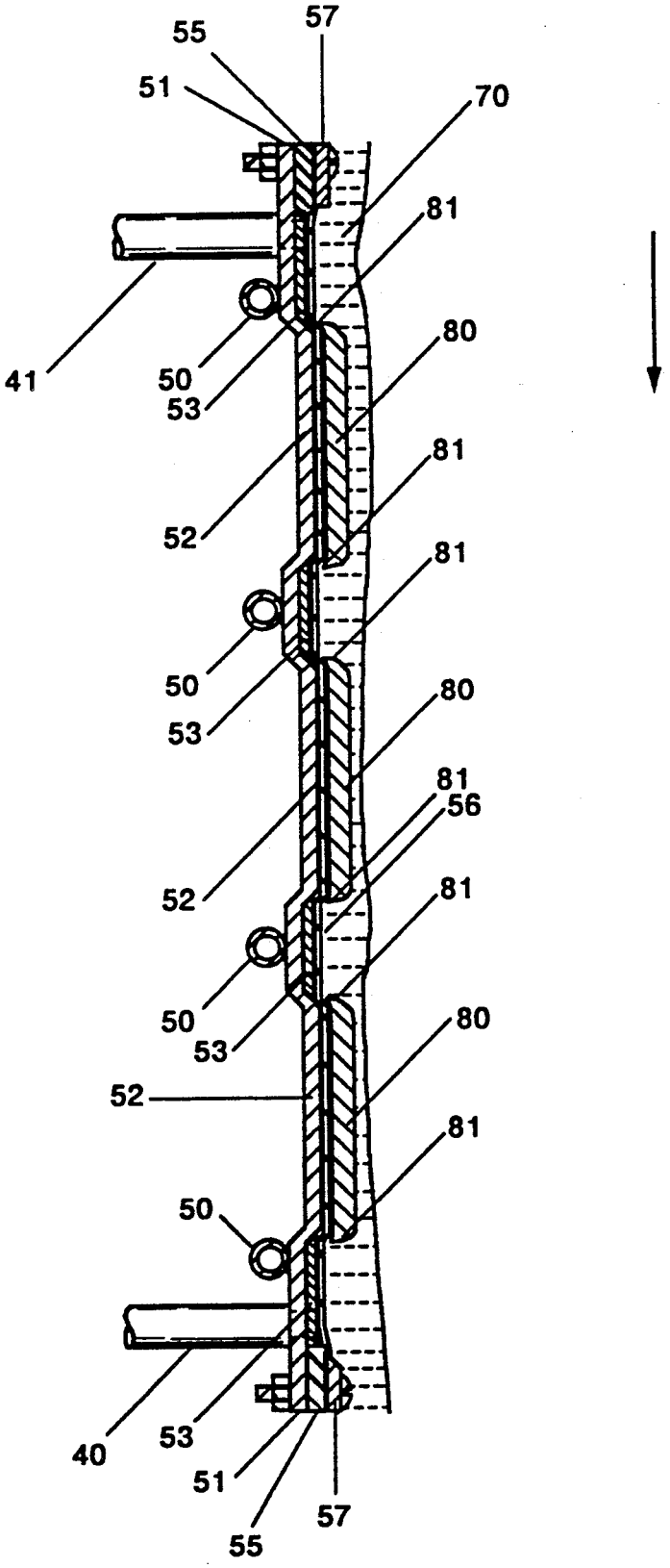

After a set period of time has elapsed, as determined by an adjustable cycle timer located within control box 43, pump 34 is turned off. This point in the operating sequence is illustrated in FIG. 4. Turning off pump 34 causes flexing fluid 36 to be pulled by gravity out of the chamber 71 and down into reservoir 35, causing a slight vacuum to be induced inside chamber 71. This hydrostatically induced vacuum exists and is sufficiently strong as long as the flexing fluid circulating circuit (shown in FIG. 1) is arranged as follows:

(1) Reservoir 35 is located such that the level of flexing fluid 36 in reservoir 35 is approximately two feet or more below the evaporator 26;
(2) the downstream end of conduit 41 is below the level of flexing fluid 36 in reservoir 35; and
(3) the flexing fluid 36 in the reservoir 35 is open to atmospheric pressure.

With the above arrangement, the force of gravity pulling the flexing fluid 36 out of evaporator 26 creates hydrostatic pressure and induces a slight vacuum inside chamber 71. The vacuum is sufficient to pull the membrane 56 into intimate contact with the plate 51 at raised freezing sites 52 for good heat transfer between the two. The evaporator 26 is designed such that when the vacuum is pulled inside the chamber 71, a minimum volume of flexing fluid 36 remains in the evaporator (a very thin film of flexing fluid 36 should always remain between the raised freezing sites 52 and the flexible membrane 56 to improve thermal conductivity between the two surfaces). Minimizing the volume of flexing fluid 36 in the evaporator during freezing reduces unnecessary cooling of the flexing fluid 36 and instead allows production of more ice.

With the flexible membrane 56 in close thermal contact with raised freezing sites 52, heat is conducted from the warm water 70, through the evaporator 26 and into the refrigerant. This causes the water 70 to cool down to its fusion temperature (32 degrees F, 0 degrees C), after which ice 80 begins to form on the exterior of the flexible membrane 56 at the raised freezing sites 52. Heat transfer from the water 70 in areas other than the freezing sites 52 is prevented by the poor thermal contact between the flexible membrane 56 and the plate 51 and by the insulating layer 53.

When a vacuum exists in chamber 71, the flexible membrane 56 is, as previously stated, brought into intimate contact with raised freezing sites 52. The flexible membrane 56 also tends to conform closely to the freezing sites 52 such that the flexible membrane 56 follows the contours of raised freezing sites 52. The "back" sides of ice cubes 80 which are formed also have these contours. These contours can facilitate the removal of the ice cubes 80 from the flexible membrane 56 when the membrane is flexed away from plate 51 by the flexing fluid 36. As shown in FIG. 4, flexible membrane 56 has conformed to the corners 81 of the raised freezing site 52. The "back" sides of ice cubes 80 also have the contour of corners 81. As will be shown in FIG. 5, this contour on the ice cubes 80 facilitates their removal from flexible membrane 56. Once the ice cubes 80 have reached the desired thickness, pump 34 is turned on. This causes flexing fluid 36 to be pumped into chamber 71 thus forcing flexible membrane 56 away from plate 51 and raised freezing sites 52.

Figure 5:
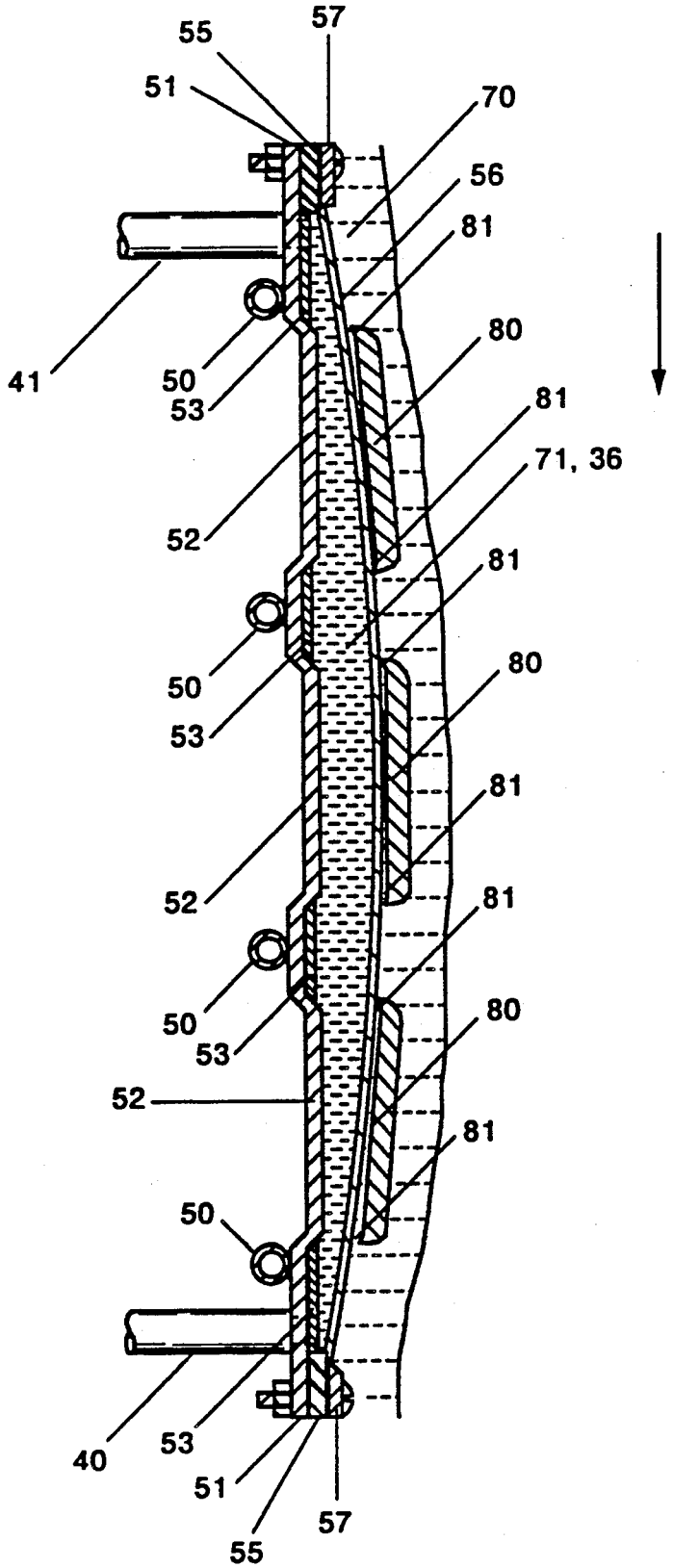

FIG. 5 illustrates flexible membrane 56 being forced away from plate 51 by the flexing fluid 36. As shown, this causes the ice cube 80 to become substantially disengaged from flexible membrane 56. The corners 81 of the ice cube 80 make it difficult for the ice to remain bonded to the now substantially flat flexible membrane 56. The ice cube 80 may not completely disengage from the flexible membrane 56 as a result of its flexing at this time, however. To insure that all the ice cubes 80 are removed, the flexing fluid 36 which flows into chamber 71 is kept at a temperature above the freezing temperature of ice. This insures that any remaining bonds between ice cube 80 and flexible membrane 56 are melted.

Figure 6:
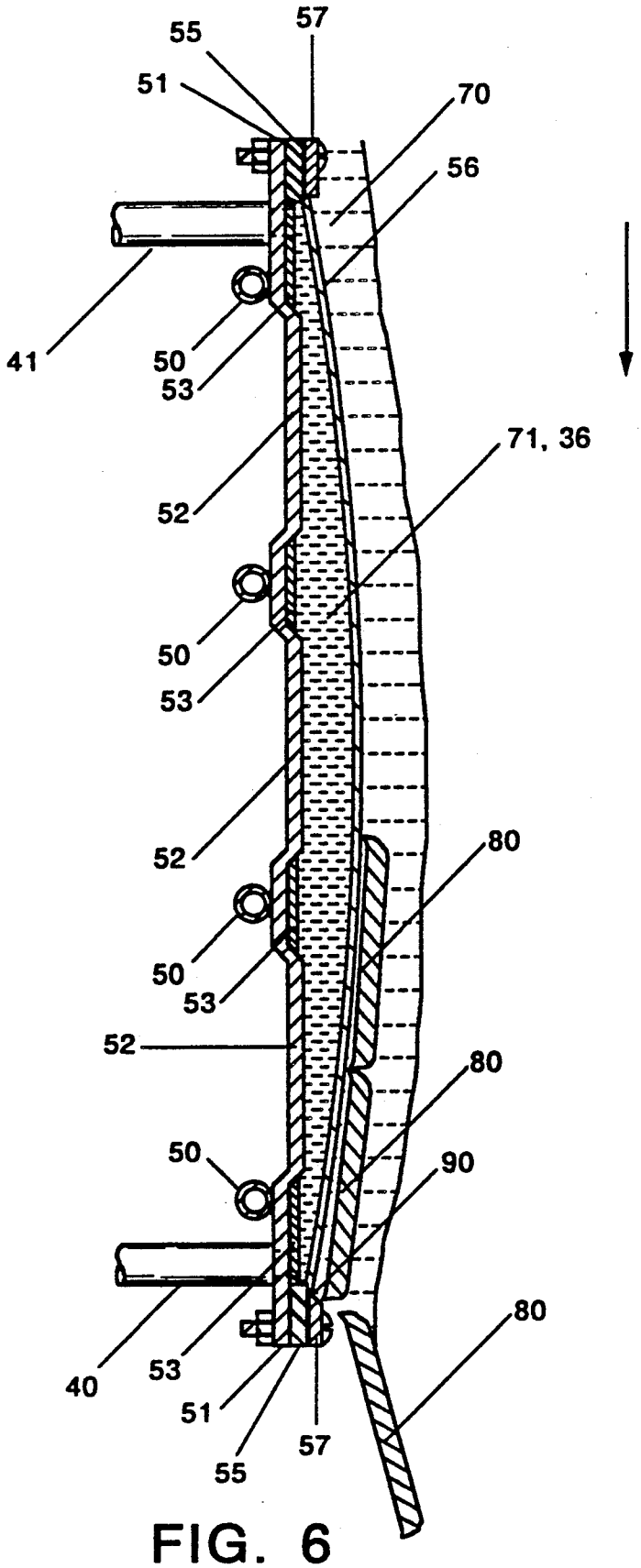

At this point in the operating sequence, ice cube 80 may still remain in contact with the flexible membrane 56, being kept there by the surface tension of the water 70 flowing across the flexible membrane 56. The ice cubes 80 do, however, slide down the flexible membrane, as shown in FIG. 6, until they reach the sharpened edge 90 of the retaining plate 57. At this point they slide off the evaporator 26 and fall into the ice holding bin below. It is important that this edge 90 be sharpened so that the interior angle formed between the edge 90 and the flexible membrane 56 is approximately 135° or more. This insures that ice cube 80 will slide readily off the evaporator 26 and will not be caught at edge 90.

After a short period of time, all of the ice cubes 80 which were formed on the flexible membrane 56 slide off the evaporator 26 into the ice holding bin below, thus completing one freezing cycle (this point in the cycle is illustrated by FIG. 3). The cycle then repeats, forming additional ice cubes as needed to fill the ice holding bin. As the freezing cycle repeats, only the flexing fluid circulating pump 34 is turned on and off. The compressor 21 and the water circulating pump 33 remain energized until the ice holding bin has been filled, at which time the entire ice machine is turned off.

As was shown in FIG. 1, a heat exchanger 37, a temperature sensor 38 and an electric heater 39 are used in reservoir 35 to control the temperature of flexing fluid 36. If the temperature of the flexing fluid 36 is not controlled, the said fluid can become so cold that the flexing fluid 36 no longer facilitates the removal of ice from the flexible membrane 56. This can cause ice to completely cover the flexible membrane 56 (even between freezing sites) resulting in the failure of the ice machine to make ice.

To maintain the temperature of the heat transfer fluid 36 above a minimum temperature, the temperature sensor 38 and the electric heater 39 are connected to a thermostatic control device located inside control box 43 which energizes the heater 39 if the temperature of the flexing fluid 36 falls below the minimum temperature. Energizing heater 39 warms the flexing fluid 36 until its temperature rises back into the desired range. This will occur when the heat available from the entering water is insufficient to maintain the flexing fluid 36 above the minimum desired temperature.

An alternate embodiment of the invention may replace the heat exchanger 37 and/or the electric heater 39 with a heat exchanger which is part of the condenser 24 or with an apparatus to exchange heat with the surrounding ambient air. Using the condenser 24 or the surrounding air as a source of heat for the flexing fluid 36 would be desirable in applications where the entering water temperature is very low. In these applications there would be insufficient heat in the water to keep the flexing fluid 36 at the proper temperature. Using the condenser 24 or the surrounding air as a source of heat would be more economical than using an electric resistance heater in these applications.

Figure 7:
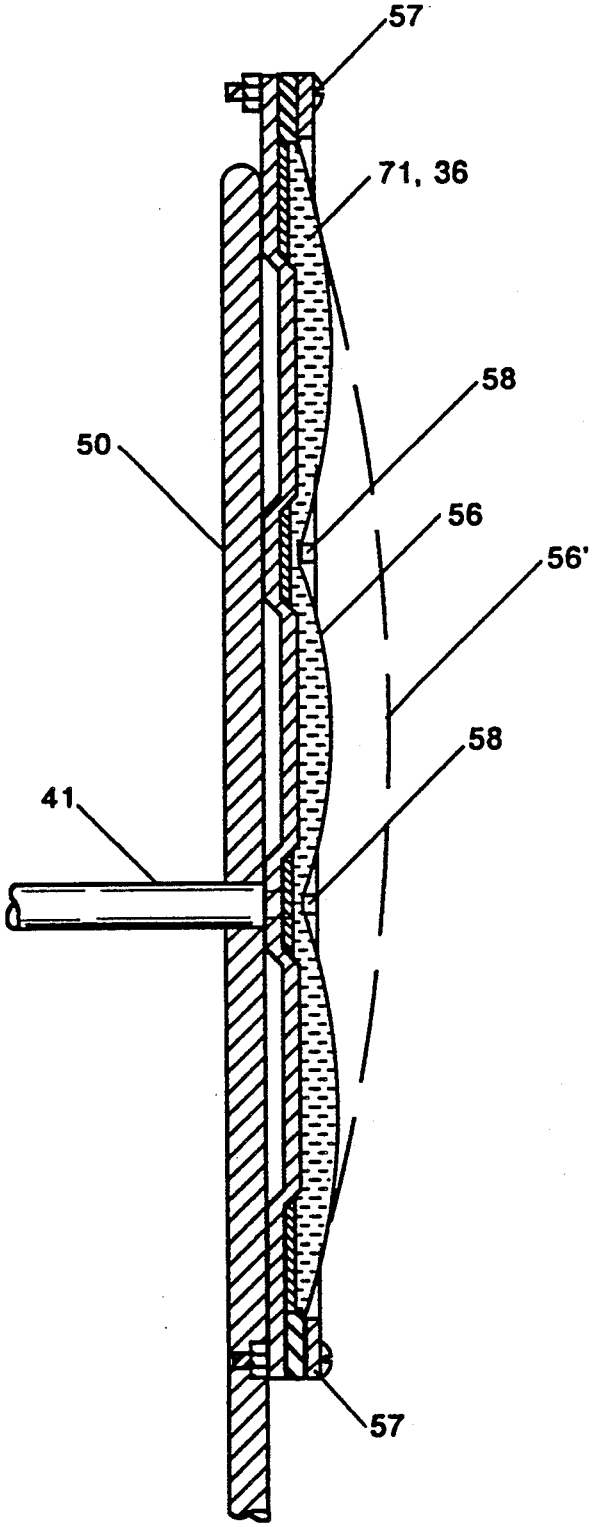
FIG. 7 is a cross-sectional view, taken along the line 7—7 of FIG. 1.

FIG. 7 illustrates the purpose of the supporting struts 58 on retaining frame 57. FIG. 7 is a cross-sectional view, taken along the line 7—7 of FIG. 1, thus looking down across the surface of the evaporator 26. The struts 58, which run vertically across the face of evaporator 26, serve three functions:

(1) They reduce the volume of fluid in chamber 71 needed to flex flexible membrane 56. Without the struts, the flexible membrane 56 flexes away from plate 51 forming an arc with a rather large radius (indicated by a dashed line numbered 56' in FIG. 7). With struts 58, flexible membrane 56 flexes away and forms a number of smaller arcs, each with a much smaller radius than 56'. The volume of flexing fluid 36 needed to fill these smaller arcs is much less than is needed to fill one large arc. This smaller volume of flexing fluid 36 reduces the time needed to flex membrane 56 since much less fluid needs to be pumped into chamber 71 in order to flex it. This speeds the harvesting of the ice cubes and increases the amount of time spent freezing rather than harvesting ice.

(2) The shorter radii of the arcs formed in the flexible membrane 56 with the struts 58 in place facilitates the removal of ice cubes from the flexible membrane 56. The greater the difference in shape or contour between the flexible membrane 56 when it is flexed and the "back" sides of the ice cubes 80, the more difficult it becomes for the ice cubes 80 to remain affixed to the flexible membrane 56. The shorter radii which results from using struts 58 increases that difference, thus making it more difficult for the ice to remain attached, and thus facilitating the harvesting process.

(3) The struts 58 help carry the force on the flexible membrane created by pumping flexing fluid 36 into chamber 71. Without struts 58, all the force applied to the flexible membrane 56 by the flexing fluid 36 must be carried by the flexible membrane 56 itself at its edges where it is attached to the retaining frame 57. This creates large stress concentrations at the edges of the flexible membrane 56 and will lead to failure if flexible membrane 56 is too large in area. With struts 58 in place, much of the load is carried by the struts 58. This allows the evaporator 26 to be comprised of a single large flexible membrane rather than numerous smaller ones.

FIGS. 8 and 9 illustrate an ice cube 100 produced using the raised freezing site 52 illustrated in FIGS. 10 and 11. The cube shown bears the word "ICE," which is formed by a layer of cloudy ice 101 on the "back" side of the cube. The word "ICE" would appear in clear letters on a white background since the majority of the "back" side of the ice cube was frozen quickly, thus resulting in white, cloudy ice 101, and the areas where the letters are were frozen slowly, resulting in clear ice 102. As the ice cube 100 is frozen, the freezing rate across the entire cube slows as the growing ice layer insulates the flexible membrane 56, this causes the majority of the ice cube to freeze clear 103.

FIGS. 10 and 11 show the raised freezing site 52 needed to create the ice cube shown in FIGS. 8 and 9. Area 110, which makes up the majority of raised freezing site 52, lies in a plane which permits it to be brought into good thermal contact with the flexible membrane 56. Areas 111 which define where the word "ICE" appears in the ice cube 100, are lower in elevation and thus cannot be brought into good thermal contact with flexible membrane 56. This configuration causes the ice forming over areas 111 to freeze clear, and the ice forming over areas 110 to form cloudy initially.

Alternatively, the ice cube 100 in FIGS. 8 could be produced such that the letters 102 are cloudy and the background 101 is clear. This could be achieved using a freezing site such as 52 in FIG. 10 where instead of having the letters 111 lower in elevation relative to the background 110 (as is shown in FIG. 10), the letters 111 would be raised up higher in elevation than the background 110.

The ice cubes produced by the apparatus and method herein are not limited to the shape or pattern shown in FIGS. 8 and 9. Virtually any overall shape is possible, as defined by the shape of the raised freezing site 52, and the pattern or design on the ice cube can be virtually any graphical image (letters, numbers, words, messages, logos, pictures, etc.). The patterns or designs on the ice cube can be either white on a clear background or clear on a white background.

By adding flavorings and/or colorings to the water supplied to the ice machine, ice cubes where the cloudy layer 101 in FIGS. 8 and 9 is flavored and/or colored can be produced.

What I claim is:

1. Apparatus for making ice comprising:

a substantially planar refrigerated surface;

a flexible ice forming membrane coupled to said refrigerated surface forming a chamber therebetween;

a water supply means for supplying water to said ice forming membrane;

remote reservoir means in fluid communication with said chamber for storing a flexing fluid;

hydrostatic liquid pressure means coupled to said chamber for flexing said membrane into contact with said refrigerated surface by the application of a lower than ambient pressure to said chamber, whereby said ice is formed on said membrane;

pump means for pumping said flexing fluid into said chamber and flexing said membrane away from said refrigerated surface, whereby said ice is detached from said membrane.

2. The apparatus of claim 1 further comprising:

heating means for maintaining said flexing fluid at a temperature above 32° F., whereby the detachment of said ice is facilitated by warming said membrane when said warm flexing fluid is pumped into said chamber.

3. The apparatus of claim 2 wherein said heating means includes an electrical resistance heater.

4. The apparatus of claim 2 wherein said heating means includes a heat exchanger means for heating said flexing fluid.

5. The apparatus of claim 4 wherein said heat exchanger means exchanges heat between the ambient air and said flexing fluid.

6. The apparatus of claim 4 wherein said heat exchanger means exchanges heat between tap water used for ice making and said flexing fluid, whereby said tap water is pre-cooled to increase the ice production of said ice making apparatus.

7. The apparatus of claim 4 wherein said heat exchanger means exchanges heat between the refrigerant in the high temperature portion of the refrigeration system used to refrigerate said refrigerated surface and said flexing fluid.

8. The apparatus of claim 2 further comprising:

means for circulating said flexing fluid through said chamber whereby said membrane is heated to assist the detachment of said ice from said membrane.

9. Apparatus for making ice comprising:

a refrigerated surface;

a flexible ice forming membrane coupled to said refrigerated surface forming a chamber therebetween;

a water supply means adjacent said ice forming membrane for distributing water onto the exterior side of said ice forming membrane;

hydrostatic liquid pressure means coupled to said chamber for flexing said membrane into contact with said refrigerated surface by the application of a lower than ambient pressure to said chamber, whereby said ice is formed on said membrane;

pump means for pumping a flexing fluid into said chamber and flexing said membrane away from said refrigerated surface, whereby said ice is detached from said membrane;

means for detecting a leakage of said flexing fluid from said chamber;

control circuitry connected to said leakage detecting means to deactivate said ice making apparatus if leakage of said flexing fluid from said chamber is detected.

10. Apparatus for making ice comprising:

a substantially planar refrigerated surface;

a flexible ice forming membrane coupled to said refrigerated surface forming a chamber therebetween;

a water supply means for supplying water to said ice forming membrane;

means for flexing said membrane into and out of contact with said refrigerated surface whereby said ice forms on said membrane when said membrane is flexed into contact with said refrigerated surface, and said ice is detached from said membrane when said membrane is flexed out of contact with said refrigerated surface;

means for producing areas of high and areas of low thermal conductivity between said refrigerated surface and said membrane whereby said ice forms on said membrane over said areas of high thermal conductivity and ice does not form on said membrane over said areas of low thermal conductivity;

means for constraining said membrane when it is flexed out of contact with said refrigerated surface such that said membrane is flexed into the shape of two or more arcs.

11. Apparatus for making ice comprising:

a refrigerated surface;

a flexible ice forming membrane coupled to said refrigerated surface forming a chamber therebetween;

a water supply means adjacent said ice forming membrane for distributing water onto the exterior side of said ice forming membrane;

means for flexing said membrane into and out of contact with said refrigerated surface whereby said ice forms on said membrane when said membrane is flexed into contact with said refrigerated surface, and said ice is detached from said membrane when said membrane is flexed out of contact with said refrigerated surface;

means for producing areas of high and areas of low thermal conductivity between said plate and said membrane whereby said ice forms on said membrane over said areas of high thermal conductivity and ice does not form on said membrane over said areas of low thermal conductivity;

means for constraining said membrane when it is flexed out of contact with said refrigerated surface such that said membrane is flexed into the shape of two or more arcs, wherein said constraining means are vertically oriented struts located proximate on said exterior side of said membrane.

12. A method for making ice cubes, comprising the steps of:

providing areas of high thermal conductivity and areas of low thermal conductivity between a substantially planar refrigerated surface and a flexible membrane;

flowing water across the exterior side of said membrane;

pumping a flexing fluid at a temperature above 32° F. into a sealed chamber formed between said refrigerated surface and said membrane, thereby filling said chamber with said flexing fluid and flexing said membrane out of contact with said refrigerated surface;

withdrawing said flexing fluid from said sealed chamber thereby causing said membrane to be drawn into stationary contact with said refrigerated surface by fluid pressure and causing said ice cubes to form on said exterior side of said membrane over said high thermal conductivity areas;

again pumping said flexing fluid at a temperature above 32° F. into said sealed chamber, thereby flexing said membrane away from said refrigerated surface and heating said membrane causing said ice cubes to become detached from said membrane through the combined action of the flexing and heating of said membrane.

13. The method of claim 12 wherein:

said flexing fluid is withdrawn from said sealed chamber by gravity into a reservoir located below the level of said chamber, whereby said membrane is drawn into contact with said refrigerated surface by hydrostatic pressure and ice forms on said exterior side of said flexible membrane over said high thermal conductivity areas.

14. Apparatus for making ice comprising:

an ice forming membrane;

a substantially planar refrigerated surface proximate said ice forming membrane;

a water supply means for supplying water to said ice forming membrane;

means for moving said ice forming membrane into stationary engagement with said refrigerated surface whereby said ice is formed on said ice forming membrane;

means for flexing said ice forming membrane out of engagement with said refrigerated surface for disengaging said ice from said ice forming membrane;

a membrane heating means for heating said ice forming membrane while said membrane is out of engagement with said refrigerated surface, whereby said ice is detached from said membrane through the action of flexing and heating of said membrane.

15. Apparatus for making ice comprising:

an ice forming membrane;

a water supply means for supplying water to said ice forming membrane;

a substantially planar refrigerated surface proximate said ice forming membrane, forming areas of high thermal conductivity and areas of low thermal conductivity between said ice forming membrane and said refrigerated surface whereby ice forms over said areas of high thermal conductivity and ice is not formed over said areas of low thermal conductivity such that the cross-sectional shape of said ice is determined by said areas of high and areas of low thermal conductivity;

said ice forming membrane and said refrigerated surface forming and defining a chamber therebetween;

a flexing fluid means located within said chamber for facilitating the movement of said ice forming membrane into and out of contact with said refrigerated surface;

a flexing fluid moving means for introducing said flexing fluid into said chamber whereby said membrane is moved out of intimate contact with said refrigerated surface and for extracting said flexing fluid from said chamber whereby said membrane is moved into intimate stationary contact with said refrigerated surface.

16. The apparatus of claim 15 further comprising:

reservoir means coupled to said flexing fluid moving means, located beneath said chamber and open to atmospheric pressure for gravitational extraction of said flexing fluid from said chamber, whereby said membrane is drawn against and into conformity with said refrigerated surface by a hydrostatically induced lower than ambient pressure in said chamber.

17. The apparatus of claim 15 further comprising:

a membrane heating means provided by maintaining said flexing fluid above a temperature of 32 degrees F with a fluid heating means whereby said ice forming membrane is heated when said warm flexing fluid is moved into said chamber by said flexing fluid moving means, disengaging said ice from said membrane through the action of flexing and heating of said membrane.

18. The apparatus of claim 17 wherein said fluid heating means includes an electrical resistance heater.

19. The apparatus of claim 17 wherein said fluid heating means includes a heat exchanger means for heating said flexing fluid.

20. The apparatus of claim 19 wherein said heat exchanger means exchanges heat between tap water used for ice making and said flexing fluid, whereby said tap water is pre-cooled to increase the ice production of said ice making apparatus.

21. The apparatus of claim 19 wherein said heat exchanger means exchanges heat between the ambient air and said flexing fluid.

22. The apparatus of claim 19 wherein said heat exchanger means exchanges heat between said flexing fluid and the refrigerant in the high temperature portion of the refrigeration system used to refrigerate said refrigerated surface.

23. The apparatus of claim 17 further comprising:

circulating means to circulate said flexing fluid past said fluid heating means and through said chamber whereby the heating of said ice forming membrane is facilitated by said circulation of said warm flexing fluid.

24. Apparatus for making ice comprising:

an ice forming membrane;

a refrigerated surface proximate said ice forming membrane;

a water supply means for supplying water to said ice forming membrane;

sealing means between said ice forming membrane and said refrigerated surface for defining a chamber therebetween;

a reservoir of flexing fluid, said flexing fluid consisting of a low freezing temperature liquid;

conduit means connecting said reservoir with said chamber;

fluid removing means for removing said flexing fluid from said chamber through said conduit means and into said reservoir and causing said ice forming membrane to be drawn by fluid pressure into engagement with said refrigerated surface whereby said ice is formed on said ice forming membrane;

fluid moving means for moving said flexing fluid out of said reservoir through said conduit means into said chamber thereby causing said ice forming membrane to flex away from said refrigerated surface for disengaging said ice from said ice forming membrane;

means for detecting a leakage of said flexing fluid from said chamber;

control circuitry connected to said leakage detecting means to deactivate said ice making apparatus if leakage of said flexing fluid from said chamber is detected.

25. A method for making ice cubes comprising the steps of:

flexing an ice forming membrane into stationary contact with a refrigerated surface;

flooding said membrane with water causing said ice to form on said membrane;

flexing said membrane out of contact with said refrigerated surface, causing said ice to mechanically detach from said membrane;

heating said membrane to thermally detach said ice from said membrane.

26. A method for making ice cubes comprising the steps of:

flexing an ice forming membrane into stationary contact with a refrigerated surface by extracting a flexing fluid from the space between said membrane and said refrigerated surface;

flooding said membrane with water causing said ice to form on said membrane;

introducing said flexing fluid at a temperature above 32 degrees Fahrenheit into said space to flex said membrane out of contact with said refrigerated surface, causing said ice to mechanically detach from said membrane and heating said membrane to thermally detach said ice from said membrane.

27. Apparatus for making ice cubes comprising:

an ice forming membrane;

a substantially planar refrigerated surface proximate said ice forming membrane, forming areas of high thermal conductivity and areas of low thermal conductivity between said ice forming membrane and said refrigerated surface, the size and shapes of said areas of high thermal conductivity defining the cross-sectional sizes and shapes of said ice cubes;

a water supply means for supplying water to said ice forming membrane;

means for moving said ice forming membrane into stationary engagement with said refrigerated surface whereby said ice cubes form on said ice forming membrane at said areas of high thermal conductivity and said ice does not form on said ice forming membrane at said areas of low thermal conductivity;

means for flexing said ice forming membrane away from said refrigerated surface for disengaging said ice cubes from said ice forming membrane.

* * * * *